United States Patent [19]

Château

[11] 4,153,032

[45] May 8, 1979

[54] IGNITION CONTROL DEVICE WITH MONOSTABLE ELEMENTS FOR PROVIDING A CONSTANT ENERGY SPARK

[75] Inventor: Louis J. Château, Rosny, France

[73] Assignee: Ducellier & Cie, Creteil, France

[21] Appl. No.: 817,590

[22] Filed: Jul. 21, 1977

[30] Foreign Application Priority Data

Jul. 28, 1976 [FR] France ..... 76 22927

[51] Int. Cl.[2] ..... F02P 1/08; H05B 41/14

[52] U.S. Cl. ..... 123/148 E; 123/146.5 A; 315/209 T; 315/209 M

[58] Field of Search ..... 123/148 E, 146.5 A, 123/117 R; 315/209 T, 209 M

[56] References Cited

U.S. PATENT DOCUMENTS

| | | | |
|---|---|---|---|
| 3,563,219 | 2/1971 | Mieras | 123/148 E |
| 3,626,910 | 12/1971 | Porsche et al. | 123/148 E |
| 3,831,571 | 8/1974 | Weber | 124/148 E |
| 3,882,840 | 5/1975 | Adamian et al. | 123/148 E |
| 3,945,362 | 3/1976 | Neuman et al. | 123/148 E |
| 3,955,723 | 5/1976 | Richards | 123/148 E |
| 4,043,302 | 8/1977 | Sessions | 123/148 E |
| 4,059,083 | 11/1977 | Habert | 123/148 E |

*Primary Examiner*—Charles J. Myhre
*Assistant Examiner*—P. S. Lall

[57] ABSTRACT

An electronic ignition control device includes a voltage step up coil with its primary winding in series with an electronic contact breaker. The contact breaker is directly controlled by a first monostable circuit which is connected to be triggered by signals from an ignition signal generator. A comparator receiver a voltage signal from a coil current transducer and compares this with a fixed voltage level, producing a square wave of duration dependent on the excess of the voltage signal above the fixed voltage level. An integrator integrates the output of the comparator and provides a pulse duration control signal to the first monostable. A second monostable triggered by the generator also produces a square of predetermined duration. A current limiting circuit is connected to limit current in the primary winding. The first and second monostable circuits and the current limiting circuit all have their outputs connected to an OR gate which controls the primary current.

1 Claim, 4 Drawing Figures

IGNITION CONTROL DEVICE WITH MONOSTABLE ELEMENTS FOR PROVIDING A CONSTANT ENERGY SPARK

The present invention concerns an electronic ignition control device for internal combustion engines, particularly for motor vehicles, the device being of the type including a generator for ignition triggering signals, means for shaping the said signals, a voltage step up coil comprising a primary winding connected in series with an electronic 'contact breaker' and a secondary winding connected consecutively to the spark plugs selected by an ignition distributor.

In devices of this kind, the ignition sparks are generated as is well known, when the current previously established in the primary winding is suddenly interrupted by mechanical or electronic contact breakers.

The creation of sparks in the combustion chambers must satisfy a first condition, i.e. that the spark must be generated at the precise instance defined by various laws of ignition advance as a function of variations of the engine speed and it is desirable on the other hand, that it shall have an energy such that the output of the engine shall be the best possible, without giving rise to an excessive consumption of current generated by auxiliary equipment.

It is known that at low engine speeds, the current consumed by the primary of the voltage step up coil is very considerable in the absence of an automatic device for varying the closure times in relation to the closure plus opening times, such ratio being known as "Dwells".

Such devices for the automatic variation of "Dwells" are known, using particularly a rotor of special form, or again, using complex circuits based on semi-conductor elements and in this particular case, are of relatively high cost.

The object of the present invention is to remedy these drawbacks and concerns more particularly the production of a spark of constant energy at the electrodes of the sparking plugs, the appropriate instant for triggering this spark forming no part of the field of the present invention.

The electronic ignition control device according to the invention, intended for an internal combustion engine, particularly for motor vehicles, and co-operating with a system including a generator for ignition triggering signals, means for shaping the said signals, a voltage step up coil, a distributor selecting each of the plugs at the electrodes of which the spark is to be produced, is characterised in that it comprises a first controlled monostable element, directly controlling the electronic contact breaker connected in series with the primary winding of the voltage step up coil, a comparator element which receives, on the one hand, a voltage proportional to the current flowing in the primary winding of the voltage step up coil and, on the other hand, a voltage of fixed value, and of which the output delivers a square wave of duration varying as a function of the input voltage being exceeded, an integrator element receiving the signal from the comparator, a second mono-stable element controlled by the shaping means, delivering a square wave of determined duration, an element for limiting the current flowing in the primary winding, an OR gate receiving the signals from the first and second monostable elements and from the element limiting the current flowing in the primary winding, in such a manner that a spark of constant energy is delivered at the electrodes of each of the spark plugs.

The following description with reference to the attached drawings will facilitate a better understanding of how the invention can be put into effect.

Figure 1:
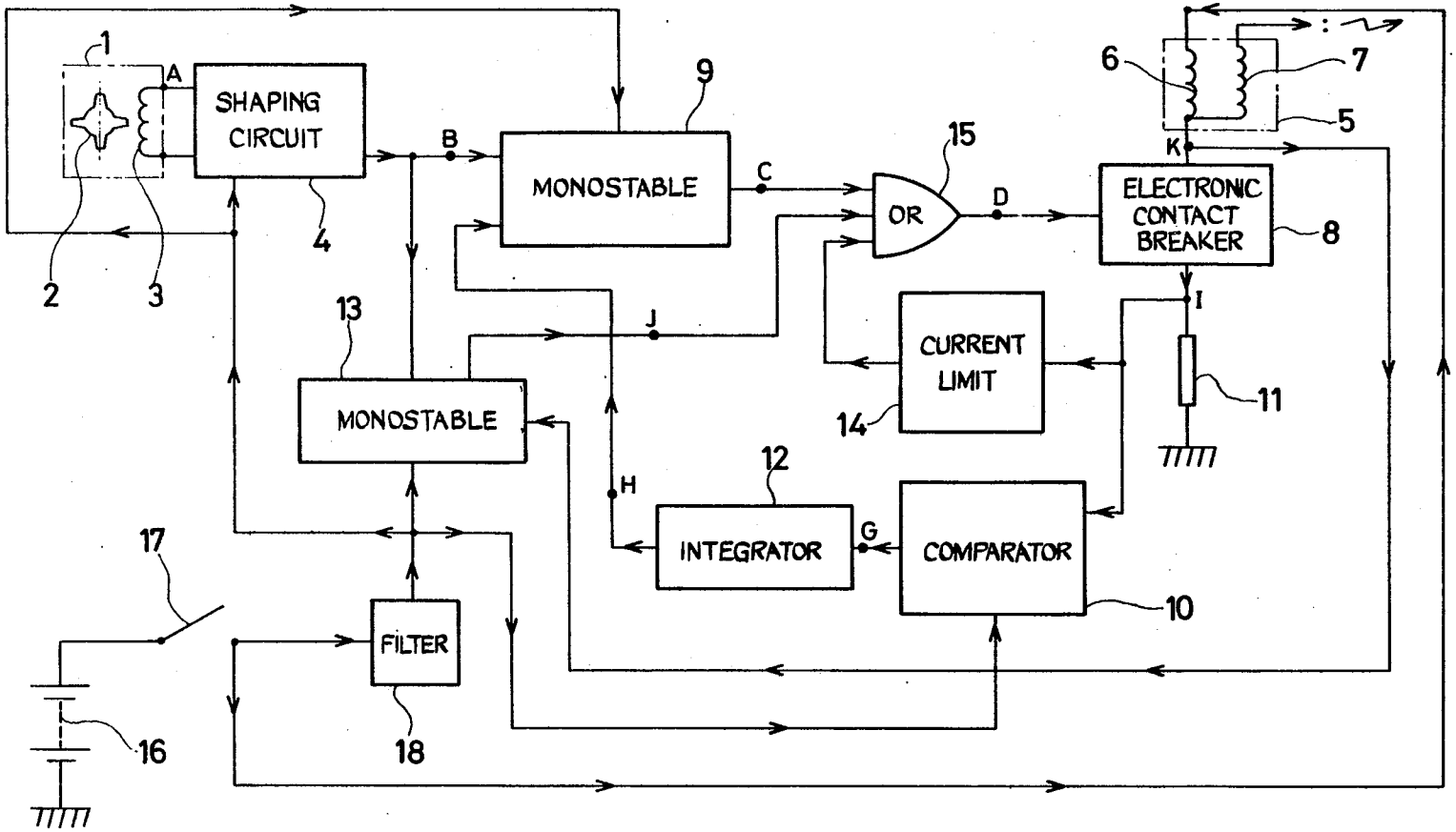
FIG. 1 is the schematic representation of the device of the invention.
Figure 3:
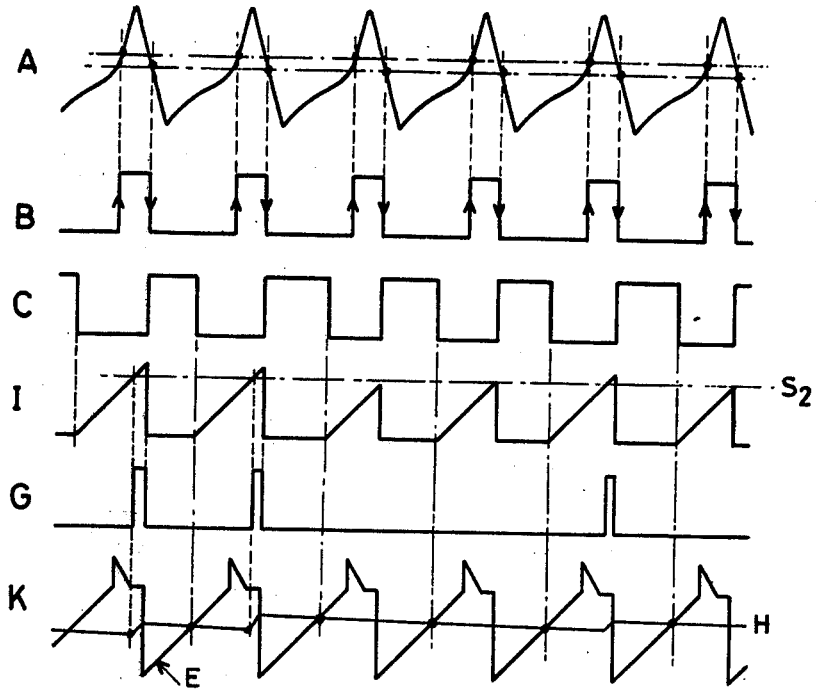
FIG. 3 represents the wave forms of various signals obtained with the aid of the circuits of FIG. 2 in established running conditions.
Figure 4:
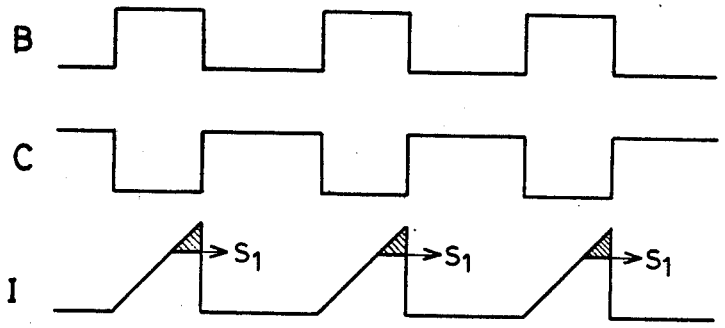
FIG. 4 represents the wave forms of various signals of the device at low speeds of rotation.

The electronic ignition control device represented schematically in FIG. 1 includes a generator 1 of ignition triggering signals of known type, such as, for example a magnetic generator comprising a rotor 2, an armature winding 3, which magnetic generator driven in synchronism by the internal combustion engine, not shown, delivers signals having the form represented in FIG. 3 by curve A.

The signal A from the magnetic generator (see FIG. 1) is shaped by a shaping circuit 4 so as to obtain at B (see FIG. 1) also in known manner, rectangular signals such as are represented in FIG. 3 by curve B.

A voltage step up coil 5, including a primary winding 6 and a secondary winding 7, has its primary winding 6 connected in series with an electronic contact breaker 8, the secondary winding 7 being connected to the electrodes of plugs (not shown) selected by a distributor of known type (not shown).

A first controlled monostable element 9 directly controls the electronic contact breaker 8 connected in series with the primary winding 6.

This monostable element 9 delivers at its output (point C see FIG. 1) signals such as those represented in FIG. 3 by curve C.

A comparator element 10 receives a voltage proportional to the current flowing in the primary winding 6 by the intermediary of a resistance 11 and compares the same with an internally generated voltage of fixed value. The output of the comparator element 10 delivers a square wave of variable width as a function of the input voltage applied to the said element being exceeded. An integrator element 12 receives the signal from the comparator 10 and delivers a voltage such as that represented by the letter H in FIG. 3. A second monostable element 13 controlled by the shaping means 4 delivers a square wave of determined duration. An element 14 limits the current flowing in the primary winding 6 of the voltage step up coil 5.

An OR gate 15 receives the signals from the first monstable element 9, the second monostable element 13 and from the element 14 limiting the current flowing in the primary 6, in such a manner that a spark of constant energy is delivered at the electrodes of selected plugs.

The primary winding 6 of the voltage step up winding 5 is connected to the energy source 16 by means of a switch 17 which can advantageously be the ignition switch of the vehicle.

A circuit 18 for filtering and protecting against accidental reversals of the supply voltage, is connected to the switch 17 and provides the supply to the shaping circuit 4, the first monostable element 9, the comparator 10 and the second monostable element 13.

Figure 2:
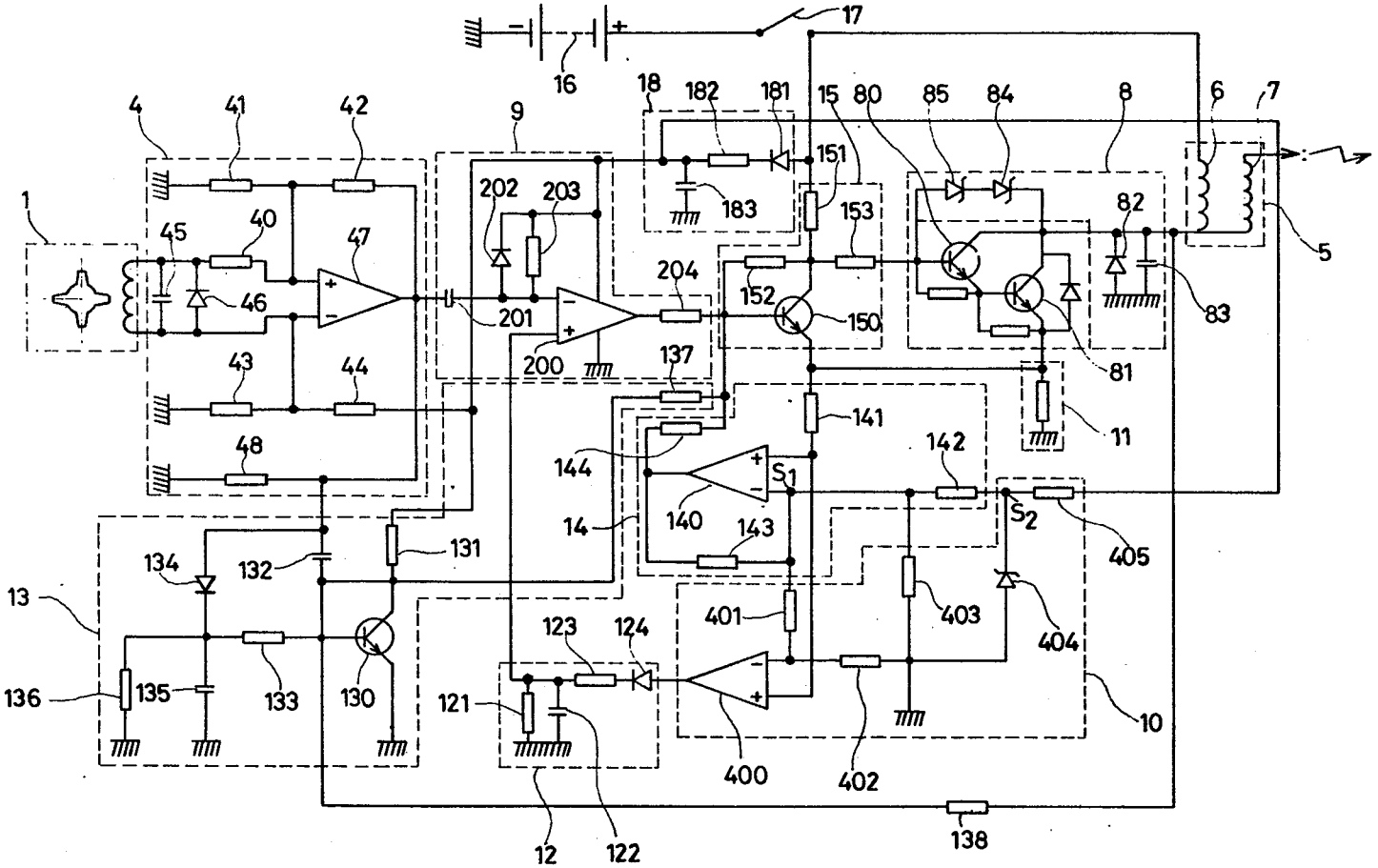
FIG. 2 is a detailed circuit diagram of a preferred embodiment of the device of the invention.

In the preferred embodiment shown in FIG. 2, the shaping circuit 4 is constituted by resistors 40, 41, 42, 43, and 44, a capacitor 45, a diode 46 and a first operational amplifier 47. The signal from the magnetic generator 1 is applied across the capacitor 45 and the diode 46. The capacitor 45 eliminates low energy interference signals which can be induced by connecting leads. The diode 46 limits possible drift of the signal generator towards negative values.

The inverting input terminal designated − of the operational amplifier 47 is biassed to a mean voltage by a bridge divider constituted by the resistors 43, and 44. The output of the amplifier 47 is connected to the non-inverting input terminal designated (+) by the resistor 42 to provide hysteresis. The resistor 40 is connected between the non-inverting input terminal and one of the outputs of the magnetic generator.

The resistor 41 permits, in the absence of input signals from the generator, the output to be at low level for normal values of offset. In other words the resistor 42 ensures the displacement of the two levels giving rise to the switching of the state of the output of the operational amplifier 47. It is thus possible by means of the resistors 40, 41 and 42 to choose the points on the generator signal where the operational amplifier 47 will give the high state output and low state output.

The resistor 48 optimises the descent times of the fronts emanating from the amplifier 47.

The controlled monostable element 9 is constituted by a second operational amplifier 200 which receives at its inverting input terminal designated (−) a signal of the form shown by FIG. 3 at E. This signal having a negative saw-toothed form is created by a capacitor 201, a diode 202 and a resistor 203 from the rectangular signals represented by FIG. 3 at B, which signals emanate from the shaping circuit 4.

The operational amplifier 200 receives at its non-inverting input designated + a voltage represented at H in FIG. 3 which voltage H results from filtering by a resistor 121, a capacitor 122, a resistor 123 and a diode 124, constituting an integrator circuit 12 of pulses which may or may not exist at the output of the comparator 10. The output of the amplifier 200 is connected to one of the inputs of the OR gate 15 by a resistor 204.

The comparator 10 is constituted by a third operational amplifier 400 which receives at its inverting input (designated −) a fixed potential resulting from the division by the resistor networks 401, 402, 403 and 142 of a reference voltage S2 generated at the cathode of a Zener diode 404 by a resistor 405 connected to the output of the filtering and supply circuit 18 constituted in known manner by a diode 181 a resistor 182 and a capacitor 183.

The operational amplifier 400 receives at its non-inverting input designated + and by means of a resistor 141, the voltage existing across the resistance 11 which measures the current flowing in the primary winding 6 of the coil 5.

An OR gate 15 constituted by a transistor 150 mounted in common emitter, is connected by a first input and by means of the resistor 204 to the output of the comparator 200 of the controlled monostable element 9. The emitter of the transistor 150 is connected to the current limiting circuit 14 and a connection of this emitter is provided with the resistor 11 to maintain the electronic contact breaker 8 in the blocked state during the oscillations created in the coil 5 at the instant of the ignition spark. The collector of the transistor 150 is connected to the output of the supply circuit 18 by means of a load resistor 151, a resistor 152 biassing the base of this transistor.

A resistor 153 transmits the state of the collector of the transistor 150 to the input of the electronic contact breaker 8 of the power control constituted by two transistors 80 and 81, arranged as a Darlington pair, of which the output controls the flow of current in the primary winding 6 of the coil 5.

The electronic contact breaker 8 is protected, in known manner against over voltages appearing during operation by elements such as a diode 82, a condenser 83, and two Zener diodes 84 and 85. The various elements described above constitute the principal control circuit controlling the coil 5 at constant energy according to a preferred embodiment of the invention.

This principal circuit functions in the following manner (see FIG. 3). B is the wave form produced by the shaping circuit 4 from the signal emanating from the magnetic generator 1.

K is the wave form at the negative input of the operational amplifier 200 constituting one of the elements of the controlled monostable element 9. This wave form is compared with the variable level H resulting from the filtering of the signals G. These signals G are pulses which appear when the level reached at the point I, i.e. across the resistance 11 (see FIGS. 1 and 2) just before the spark, is greater than the required nominal value represented by the reference potential S2.

The pulse G will be of width proportional to the excess and consequently the modification of Level H will be more rapid.

The rectangular wave form C from the operational amplifier 200 controls the electronic contact breaker 8, by means of the transistor 150 and the OR gate 15, which contact breaker permits the passage of current in the primary winding 6.

The current builds up according to the curve I and the descending flank of B which interrupts this build-up produces the spark.

However, in order to obtain a satisfactory operation of the device of the invention in transistory or limit situations, it is convenient to add complementary circuits.

To this end, the device includes a current limiting element 14 which assures limitation of the current flowing in the primary 6 of the coil 5 as soon as this current has reached a value slightly higher than the predetermined value.

The principal control circuit previously described is adequate for most kinds of operation of internal combustion engines i.e. for controlling the spark current during steady state conditions, but the principle itself of control which defines what has to be done for the sequence n to follow, after the immediately preceding sequence n−1 is not convenient if very large accelerations of the engine cause the sequence n to be less in time than the sequence n−1.

This is the case, for example, for the operational zone of the engine which is located between the starting speed which is a very slow speed and the tick-over speed which is a slow speed.

In this region of low speeds, the form of signal from the magnetic generator and the predetermined thresholds of the shaping circuit cause the pulse from the shaping circuit to arrive before the rising level of the saw tooth signal E has reached the level H. The rising front of this pulse transmitted by the condenser 201 eliminates the normal function obtained by means of the saw tooth signal E and synchronises the start of changing of the coil on this front before this pulse.

Because of this and in the low speed region which is the critical region as far as concerns accelerations, the charge time of the coil becomes clearly greater and this means that without other precautions, the current flowing in the primary winding would reach high values. It is thus convenient to limit this current when it has reached a value slightly greater than the predetermined value.

This limitation is effected by a second control circuit constituted essentially by the limiting circuit 14 comprising a third operational amplifier 140 which compares by means of the resistor 141, the fixed value of voltage present across the resistor 11 with a constant threshold voltage S1 available at the common point of the resistors 142 and 401. The gain of the operational amplifier 140 is limited by a feed-back resistor 143. The output of the amplifier 140 is connected by means of a resistor 144 to the second input of the OR gate 15 which controls the electronic circuit breaker 8, in such a manner that when the current has reached the threshold value S1, the automatic limiation of the current flowing in the primary winding 6 to the predetermined value enables, also in this kind of operation, a spark of constant energy to be obtained at the electrodes of each of the spark plugs.

When operating at high speeds of rotation of the internal combustion engine, the ignition spark must have a duration sufficient to ensure a satisfactory operation. Experience shows that for an engine rotating at 6,000 revs per minute, a duration of 1 millisecond is acceptable.

Taking into account the elements of the device already described, this duration is obtained by means of the monostable element 13 controlled by the shaping circuit 4. This monostable element 13 is constituted by a transistor 130 mounted in common emitter, which transistor 130 is connected by its collector to the filtering circuit 18 by means of a load resistor 131. A condenser 132 which determines the time constant of 1 millisecond duration is recharged by a resistor 133, which resistor is connected to the common point of a circuit constituted by a diode 134, a capacitor 135 and a resistor 136. pulses appear at the output of the operational amplifier 47 of the shaping circuit 4.

The diode 134 transmits these pulses to the condenser 135, which has no time to be significantly discharged, between two successive pulses, in the resistor 136. Consequently a permanent high voltage is established at the common point of the resistor 136, the capacitor 135, the resistor 133 and the diode 134. The descending fronts of the pulses from the shaping circuit 4, transmitted by the capacitor 132 to the transistor 130 block the said transistor during 1 millisecond, the transistor 130 returning to conductive state when the resistor 133 has recharged the capacitor 132.

The positive pulses existing at the collector of the transistor 130 are transmitted by means of the resistor 137 to the third input of the OR gate 15, which input being connected to the base of the transistor 150 prevents a requirement for flow of current in the primary winding 6. The function of the circuit constituted by the diode 134, the capacitor 135 and the resistor 136 is to bring the transistor 130 to the blocked condition when the engine is stopped, as a result of which, and by means of the transistor 151 of the OR gate 15, the electronic contact breaker 8 will be maintained in a non-conductive state and no current will flow in the primary winding 6, at the aforesaid time constant, of the circuit constituted by the capacitor 135 and the resistor 136, i.e. in this embodiment two or three seconds after the engine has stopped.

In order to avoid this interruption of current in the primary winding from causing a spark at the plug electrodes, the gain of this loop, and consequently the speed of cut-off is limited by a resistor 138. In summary, the device which is the object of the present invention ensures that the energy stored in the voltage step-up coil will have a constant value at the moment of triggering of the ignition spark, whatever may be the operating conditions of the internal combustion engine, i.e. whatever may be the speed of rotation of the engine the variations of supply voltage, or the variations of temperature.

The condition mentioned above, i.e. spark of constant energy is obtained by the choice and arrangement of the various elements of the device in such a manner that if the current flowing in the primary winding is greater or less than the desired current, and starting from this variation the device determines the instant at which current supply to the coil is initiated, in such a manner that the current has attained the predetermined value at the time of the following spark.

The components of the device according to the preferred embodiment are the following:

| | | | | | | | |
|---|---|---|---|---|---|---|---|
| 40 - | Resistance | ¼ | W = 8.2 K Ω | 152 - | Resistance | ¼ | W = 6.8 K Ω |
| 41 - | " | " | = 330 K Ω | 151 - | " | " | = 150 K Ω |
| 42 - | " | " | = 330 K Ω | 141 - | " | " | = 22 K Ω |
| 43 - | " | " | = 470 K Ω | 143 - | " | " | = 56 K Ω |
| 44 - | " | " | = 470 K Ω | 401 - | " | " | = 56 K Ω |
| 48 - | Resistance | ¼ | = 1 K Ω | 123 - | Resistance | ¼ | = 100 K Ω |
| 203 - | " | " | = 470 K Ω | 121 - | " | " | = 3.3 M Ω |
| 133 - | " | " | = 180 K Ω | 402 - | " | " | = 1 K Ω |
| 136 - | " | " | = 150 K Ω | 403 - | " | " | = 1.5 K Ω |
| 131 - | " | " | = 2.2 K Ω | 142 - | " | " | = 2.2 K Ω |
| 204 - | " | " | = 4.7 K Ω | 405 - | " | " | = 1 K Ω |
| 137 - | " | " | = 2.2 K Ω | 153 - | " | " | = 33 Ω |
| 144 - | " | " | = 2.2 K Ω | 11 - | " | 3W | = 0.1 Ω |
| | | | | 182 - | " | ¼ | = 15 Ω |
| | | | | 138 - | " | " | = 2.2 M Ω |

| | | | | |
|---|---|---|---|---|
| 45 - | polyester | condenser | 100 V = 22 | nanofarads |
| 201 - | " | " | 100 V = 0.1 | microfarad |
| 135 - | chemical | 16 V = 10 | microfarads | |
| 132 - | polyester | " | 100 V = 10 | nanofarads |
| 122 - | " | " | 100 V = 0.47 | microfarad |
| 83 - | " | " | 630 V = 0.22 | microfarads |
| 183 - | chemical | " | 16 V = 100 | microfarads |

-continued

| | |
|---|---|
| 47<br>140<br>200<br>400 | Circuit L M 324 - Motorola |

46 - 134 - 202 - and 124 - Diodes 1 N 4148 - Texas Instruments
404 = Zener Diode 5.1 V
181 = Diode 1 N 4004
84 and 85 = Zener Diodes PL 180 and PL 200
82 = Diode F 102
80 and 81 = Darlington BU 322 A
130 - transistor BC 170 C
150 - transistor BC 337

It is well understood that modifications can be made to the embodiment described without departing from the scope of the invention.

I claim:

1. An electronic ignition control for an internal combustion engine comprising the combination of (a) an ignition triggering signal generator adapted to be drivingly connected to an engine, the ignition of which is to be controlled;

(b) a pulse shaping circuit connected to the generator;

(c) a controlled monostable circuit connected to said shaping circuit so as thereby to be triggered into producing an output and having a control terminal the voltage signal at which determines the duration of the output;

(d) an OR gate having one input terminal connected to the output of the controlled monostable circuit;

(e) an electronic circuit breaker element controlled by said OR gate;

(f) a voltage step-up coil having a primary winding in series with said circuit breaker element and a secondary winding for connection in a circuit with a distributor and spark plugs;

(g) current sensitive means sensitive to the current flowing in said primary winding and producing a voltage signal proportional thereto;

(h) current limiting means connected to said current sensing means and to said OR gate so as to limit the primary current to a predetermined level;

(i) current comparator means connected to said current sensitive means and producing a pulse output of duration determined by the length of time for which the current sensing means output is greater than a set level corresponding to a primary current less than said predetermined level;

(j) an integrator circuit connecting to said current comparator means to said control terminal of the controlled monostable circuit so as to control the output duration of the controlled monostable circuit in accordance with the average duration of the output pulses of the comparator means; and (k) a second monostable circuit having a fixed duration output connected to be triggered by the pulse shaping circuit and connected to the OR gate;

(l) the electronic circuit breaker element being switched off by the controlled monostable circuit each time a triggering signal is produced by the triggering signal generator so as to interrupt the primary current and produce a spark and being switched on again when both the controlled monostable circuit output duration and the second monostable circuit output duration have expired; and (m) the current flowing in the primary being limited by said current limiting circuit whilst the contact breaker element is in its switched on state.

* * * * *